United States Patent [19]

Andersson

[11] 3,938,727

[45] Feb. 17, 1976

[54] DISPOSABLE CARDBOARD PLATES

[75] Inventor: Karl Gösta Bertil Andersson, Halmstad, Sweden

[73] Assignee: Duni Bila AB, Halmstad, Sweden

[22] Filed: Aug. 5, 1974

[21] Appl. No.: 494,974

[30] Foreign Application Priority Data

Aug. 6, 1973 Sweden ..... 7310754

[52] U.S. Cl. ..... 229/2.5 R; D7/1; D7/36

[51] Int. Cl.[2] ..... B65D 1/42; B65D 1/34

[58] Field of Search ..... 229/2.5; D9/219, 220; D7/37, 38, 1, 16–21, 23–27, 29–36, 71, 37, 38, 83, 84

[56] References Cited

UNITED STATES PATENTS

| | | | |
|---|---|---|---|
| 192,955 | 7/1977 | Van Skelline | 229/2.5 |
| 2,296,808 | 9/1942 | Chaplin | 229/2.5 |
| 2,738,915 | 3/1956 | St. Clair | 229/2.5 |
| 3,098,597 | 7/1963 | Johnson et al. | 229/2.5 |
| 3,104,776 | 9/1963 | Bostrom | 229/2.5 X |
| 3,459,356 | 8/1969 | Sparks | 229/2.5 X |

*Primary Examiner*—Davis T. Moorhead

*Attorney, Agent, or Firm*—Ostrolenk, Faber, Gerb & Soffen

[57] ABSTRACT

A disposable cardboard plate having an origamically corrugated brim including ridges and intervening grooves. The plate has been pressed from a flat cardboard blank to form inclined end walls at the outer ends of the grooves between the ends of adjacent ridges, and a flat edge flange extending continuously around the plate to lock the corrugations in their predetermined configuration, together with said end walls.

6 Claims, 8 Drawing Figures

DISPOSABLE CARDBOARD PLATES

The present invention relates to disposable cardboard plates pressed from a flat blank of cardboard to form a plate having a bottom, a side wall and a brim, at least a number of evenly spaced portions along the circumference of the plate being pleated or corrugated.

If the plate is circular, the corrugations are normally evenly distributed along the whole circumference of the plate. A plate deviating more or less from the circular shape may also be corrugated along the whole circumference or have a number of circumferentially spaced corrugated portions along the circumference, whereas the intermediate portions have a brim which is smooth or has very few corrugations.

The method of pressing cardboard plates by urging the fibers of the cardboard material to the desired shape and corrugation (plaiting) is well known in the art.

The present invention relates to such cardboard plates in which the plaiting (folding) of the side wall and the brim is origamic, that is the brim has on its upper side corrugations, at least in a number of areas, which present ridges and intervening grooves in the rim, whereas the side wall has grooves and ridges respectively registering with the ridges and grooves respectively of the brim.

In prior art plates of the kind under consideration, the grooves of the brim extend across the brim and are open at their inner as well as at their outer ends.

However, the open grooves on the upper side of the brim will provide channels for liquid content such as soup, sauce etc. to pour out at the edge of the brim.

A further disadvantage is that the corrugations of the brim may be flattened out rather easily when subjected to pressure, since there are no effective means for locking the corrugations together. When the corrugations of the rim are flattened out more or less, the corrugations of the side wall will also be flattened out more or less so that the volume of the plate will be reduced correspondingly.

It is therefore a general object of the invention to provide a cardboard plate which is pressed from a flat carboard blank to form a plate having a greater volume than known types of corrugated cardboard plates made from the same size of blank and in which the corrugations of the rim are all effectively locked together to maintain the shape of the plate when subjected to a predetermined pressure and to provide an improved rigidity of the plate.

In accordance with the invention this general object is attained by a cardboard plate having the features set forth in the annexed claims.

Two preferred embodiments of the inventive cardboard plate are shown by way of example in the accompanying drawings.

Figure 1:
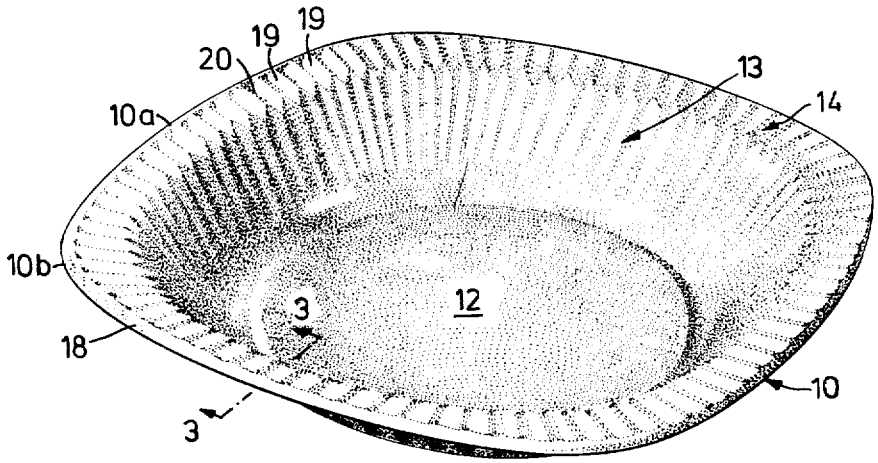
Figure 2:
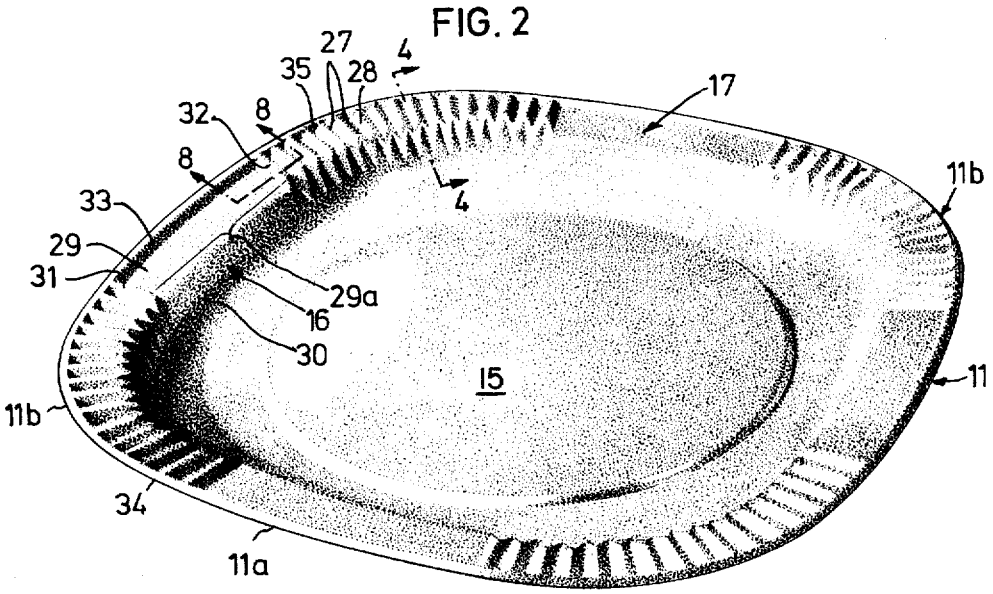
Figure 3:
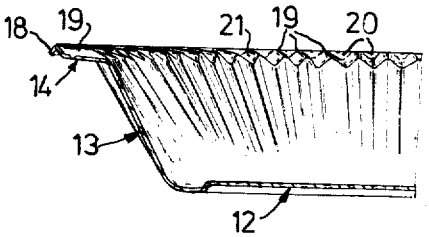
Figure 4:
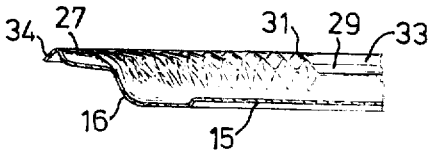
Figure 5:
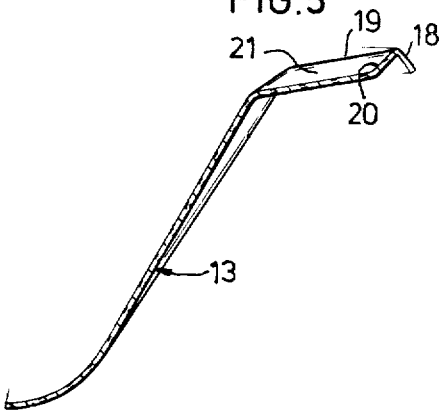
Figure 6:
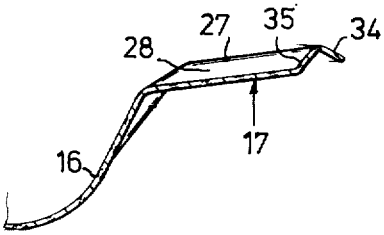
Figure 7:
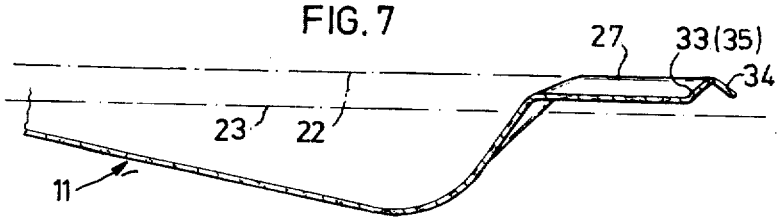
Figure 8:
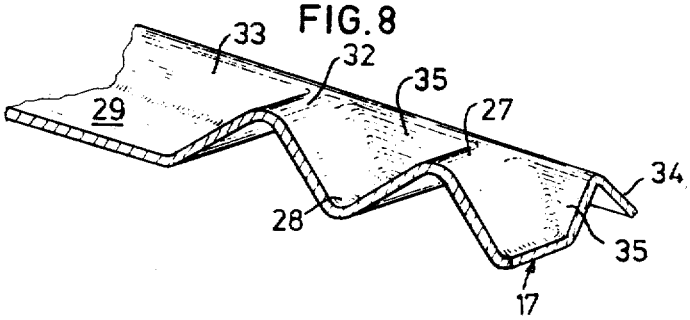

FIG. 1 is a diagrammatic perspective view of a deep cardboard plate according to the invention having corrugations evenly distributed along its whole circumference, FIG. 2 is a diagrammatic perspective view of a shallow cardboard plate according to the invention corrugated merely at its corner portions and having smooth side portions therebetween, FIG. 3 is a cross-section along line 3—3 in FIG. 1, FIG. 4 is a cross-section along line 4—4 in FIG. 2, FIG. 5 is an enlarged cross-section of the edge of the plate in FIG. 1, FIG. 6 is an enlarged cross-section of the edge of the plate in FIG. 2, FIG. 7 is a diagrammatic cross-section of the plate in FIG. 2 in a tilted or inclined position, two alternative liquid levels being indicated by dotted lines, and FIG. 8 is a partial enlarged broken detail view of the shallow plate along line 8—8 in FIG. 2.

The deep plate 10 and the shallow plate 11 respectively in FIGS. 1 and 2 are both pressed from a single cardboard blank according to conventional methods. However, the press tools are shaped to give the specific configuration of the edges of the plates in accordance with the present invention as described below.

The deep plate 10 has a bottom 12, a corrugated side wall 13 and a corrugated brim 14.

The shallow plate 11 has a bottom 15, a side wall 16 and a brim 17.

The general configuration of both plates deviates from a circular shape and has four convex portions 10a and 11a respectively, connected by rounded corner portions 10b and 11b respectively.

In contrast to the deep plate 10, the shallow plate 11 is corrugated merely at its corner portions, having corrugations on the side wall 16 and the brim 17, as will be seen from FIG. 2.

The corrugations of both plates are obtained by pressing the cardboard sheet material to obtain a well-known so-called origamic corrugation or pleat (folding) which means that the brim is shaped with alternating ridges and grooves, and that the side wall is also formed with alternating ridges and grooves, the ridges of the brim registering with the grooves of the side wall.

In accordance with the invention, when pressing the plates to their final shape, the fiber material of the cardboard is upset, compressed and stretched in a manner known per se to provide the desired design of the edge portion of the brim 14 and 17 respectively, As will be seen from FIGS. 1, 3 and 5, the outer edge of the brim has been pressed to a flat edge flange 18 directed outwardly and downwardly and forming a continuous ring along the circumference of the brim. The fiber material in the edge flange 18 has been compressed in the circumferential direction to form a relatively stiff and rigid edge flange. However, a portion of this fiber material has been urged to fill the space between the ends of the ridges 19 on the brim and thus to form inclined end walls 20 at the outer ends of the grooves 21 between each pair of adjacent ridges 19.

Thus, the channels formed by the grooves 21 will be closed at their outer ends, which means an increased effective volume of the plate, and further, when the plate is slightly tilted, for example when used in ships rolling slightly in the sea, the liquid content in the plate may have a level 22 as illustrated in FIG. 7 for the shallow plate 11 which level is considerably higher than the level 23 possible with known plates where the grooves in the brim are open at their outer ends. Therefore, a plate according to the invention may be filled with a greater volume of liquid content such as soup, sauce, etc. than known plates having open grooves in the brim.

As will be seen from the foregoing, the side walls of adjacent ridges 19 facing each other will be firmly locked together at their outer ends by the inclined end walls 20 and the ridges 19 will further be held firmly together by means of the continuous edge flange 18.

The corrugations of the brim 14 formed by the side walls of the ridges and grooves respectively will thus be effectively secured in predetermined angular positions. The continuous flange 18, together with the inclined end walls 20, as seen in FIG. 5, will provide a V-shaped edge section which reinforces the rim to make the plate more rigid.

The shallow plate 11 is corrugated merely at its corner portion and this corrugation is the same as described in connection with the deep plate 10 and is comprised of ridges 27 and intervening grooves 28.

The shallow plate 11 has slightly curved side portions between its rounded corner portions, each side portion having a smooth brim line 29 and a corresponding smooth side wall portion 30 forming the inside of the plate. The smooth brim portion 29 is located between the outermost ridges 31 and 32 of adjacent corner portions and thus forms the bottom of a wide groove 29a between the two ridges 31,32. The ends of the opposing side walls of the ridges 31,32 are connected by an inclined end wall 33 which closes the outer end of the wide groove 29a between the ridges 31,32 and which is formed in connection with the press forming of the continuous edge flange 34. This continuous edge flange and the inclined long end wall 33 between the respective pair of outer ridges 31,32 and the inclined end walls 35 between the ridges 27 in the corrugated corner portions of the brim 17 will provide the same effective locking of the corrugations and the predetermined shape of the plate as described in connection with the deep plate 10. Further, the advantage of the inventive design when tilting the plate is particularly pronounced for the shallow plate 11 is understood from FIG. 7.

What I claim is:

1. A plate comprising a bottom defining a predetermined contour; a continuous side wall surrounding said bottom and integrally joined to said bottom along said contour, said side wall extended upwardly from said bottom in an inclined fashion; and a brim integrally joined to and surrounding said side wall and extending generally parallel to said bottom;

said side wall and said brim being shaped along each of a plurality of spaced portions of the circumference of said plate with an origamically folded section having a plurality of alternating grooves and ridges formed in said side wall in registration with a similar plurality of alternating ridges and respectively formed in said brim;

an outer portion of said brim extending upwardly and away from said bottom and forming an end wall enclosing the outer end of each brim groove, to prevent passage of the contents of said plate therethrough when said plate is tilted to fill said brim grooves with said contents.

2. A plate as set forth in claim 1, wherein said brim further comprises a continuous edge flange integrally joined to said end walls and extending outwardly therefrom.

3. A plate as set forth in claim 1, wherein said end wall are upwardly and outwardly inclined with respect to said bottom and wherein said brim further includes a substantially smooth edge flange extended outwardly and downwardly from said end wall to form an inverted V-section therewith.

4. A plate as set forth in claim 3, wherein said side wall and said brim have a spaced plurality of aligned rounded corner portions, each of said rounded corner portions being spaced from an adjacent corner portion and having one of said origamically folded sections, the outer end of each brim groove of each said origamically folded section being enclosed by said end walls, said end walls merging into said edge flange.

5. A plate as set forth in claim 4, wherein a portion of said brim intermediate a pair of adjacent corner portions has a smooth surface generally parallel with said bottom; said brim intermediate portion further including another end wall upwardly and outwardly inclined from said smooth brim portion and another edge flange extended outwardly and downwardly from said another end wall; said another end wall and said another edge flange merging at either end thereof respectively into said end wall and said edge flange of said folded sections to form a continuous plate flange.

6. A plate as set forth in claim 1, wherein said plate is formed from pressed cardboard.

* * * * *